US008840337B2

(12) United States Patent
Fredrickson et al.

(10) Patent No.: US 8,840,337 B2
(45) Date of Patent: Sep. 23, 2014

(54) MOBILE APPLICATOR LID WITH SEAL ARRANGEMENT

(75) Inventors: Steven H. Fredrickson, Minneapolis, MN (US); Barry W. Mattson, Elk River, MN (US); Christopher A. Lins, Crystal, MN (US); Thomas L. Triplett, Rockford, MN (US); Bradley K. Voigt, Maple Lake, MN (US); Charles W. Dawson, Big Lake, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

(21) Appl. No.: 13/980,160

(22) PCT Filed: Jan. 19, 2012

(86) PCT No.: PCT/US2012/021840

§ 371 (c)(1),
(2), (4) Date: Jul. 17, 2013

(87) PCT Pub. No.: WO2012/100031

PCT Pub. Date: Jul. 26, 2012

(65) Prior Publication Data

US 2013/0302090 A1 Nov. 14, 2013

Related U.S. Application Data

(60) Provisional application No. 61/434,059, filed on Jan. 19, 2011.

(51) Int. Cl.
*B65D 51/04* (2006.01)
*B65D 45/02* (2006.01)

(52) U.S. Cl.
USPC ..... 404/111; 220/378; 220/849

(58) Field of Classification Search
USPC ..... 220/345.6, 378, 849; 404/111; 277/644
See application file for complete search history.

(56) References Cited

U.S. PATENT DOCUMENTS

| | | | |
|---|---|---|---|
| 4,565,467 | A | 1/1986 | Eigenmann |
| 4,623,279 | A | 11/1986 | Smith |
| 4,630,965 | A | 12/1986 | Nguyen et al. |
| 6,478,507 | B2 | 11/2002 | Schroeder et al. |
| 2003/0087015 | A1 | 5/2003 | Wyslotsky et al. |

FOREIGN PATENT DOCUMENTS

| | | | |
|---|---|---|---|
| JP | 1312105 | A | 12/1989 |

OTHER PUBLICATIONS

International Search Report and Written Opinion of the Patent Cooperation Treaty Office in application No. PCT/US2012/021840 dated Jun. 26, 2012.

*Primary Examiner* — Gary Hartmann
(74) *Attorney, Agent, or Firm* — Kinney & Lange, P.A.

(57) ABSTRACT

A screed die box includes a screed die bucket, a screed die box gate, a screed die box lever, a screed plate, and a positioning member. The screed die box gas is slidably connected at the bottom of the screed die bucket. The screed die box lever is rotatably connected to the screed die bucket and the screed die box gate for sliding the screed die box gate between an open position and a closed position. The screed plate is slidably connected along an aft side of the screed die bucket and includes a positioning aperture. The positioning member is located in the screed die bucket and engages the screed plate, the positioning member sliding the screed plate as the positioning member is rotated.

12 Claims, 7 Drawing Sheets

MOBILE APPLICATOR LID WITH SEAL ARRANGEMENT

BACKGROUND

The present invention relates generally to pavement marking, and more particularly to a seal arrangement for a lid of a kettle.

Alkyd and hydrocarbon thermoplastics are commonly used to mark pavement surfaces with visible lines and symbols such as lane dividers and guide lines. In particular, thermoplastics provide a durable alternative to pavement painting, and are commonly used to mark street intersections, parking lots, and other high-traffic pavement surfaces from which paint would quickly wear away.

Thermoplastics are conventionally applied to pavement surfaces using a mobile applicator comprising a heated reservoir or kettle, and an application screed die. Melted thermoplastic is dispensed from the kettle at a controlled rate and applied in a thin layer atop pavement surfaces with the screed die. Some applicators further comprise secondary burners which heat secondary reservoirs or screed die. Many applicators burn pressurized gas, such as propane and butane, at secondary burners and to heat applicator kettles. Manually driven and self-powered applicators are both relatively common, and some applicators can be attached to and driven by vehicles.

Conventional thermoplastics must be brought to melt temperatures of 177 to 250° C. (350 to 480° F.) prior to application. Existing systems use a central mixer-melter to bring thermoplastics to these temperatures. Once melted, a load of thermoplastic from the central mixer-melter is transferred to the kettle of a mobile applicator for pavement marking. The applicator kettle is heated to prevent thermoplastic from resolidifying before it is applied to the pavement surface. Often, a single central mixer-melter may service a plurality of applicators on a job site.

Due to the high temperatures at which thermoplastics melt, fumes can be released that are harmful to people. In addition, it takes a large amount of energy to heat the thermoplastics to those temperatures. And once the thermoplastics have cooled, they can adhere to the processing equipment and must be heated again for removal. While conventional kettles have lids to prevent some of these effects, they can be inefficient and easily fouled.

SUMMARY

In one embodiment of the present invention, a seal arrangement for a mobile applicator includes a kettle, a seal jamb, a kettle lid, and a lid seal. The seal jamb is attached to the kettle, and the kettle lid is rotatably connected to the kettle and can be rotated between an open position and a closed position. The lid seal is connected to the kettle lid and engages the seal jamb when the kettle lid is in the closed position.

In another embodiment of the present invention, a mobile applicator includes a frame, a kettle, wheels, a screed die box, a seal jamb, a kettle lid, and a lid seal. The kettle is attached to the frame for holding thermoplastic material, and the wheels are rotatably connected to the frame. The screed die box is connected to the frame for dispensing thermoplastic material. The seal jamb is attached to the kettle, and the kettle lid is rotatably connected to the kettle and can be rotated between an open position and a closed position. The lid seal is connected to the kettle lid and engages the seal jamb when the kettle lid is in the closed position.

DETAILED DESCRIPTION

Figure 1:
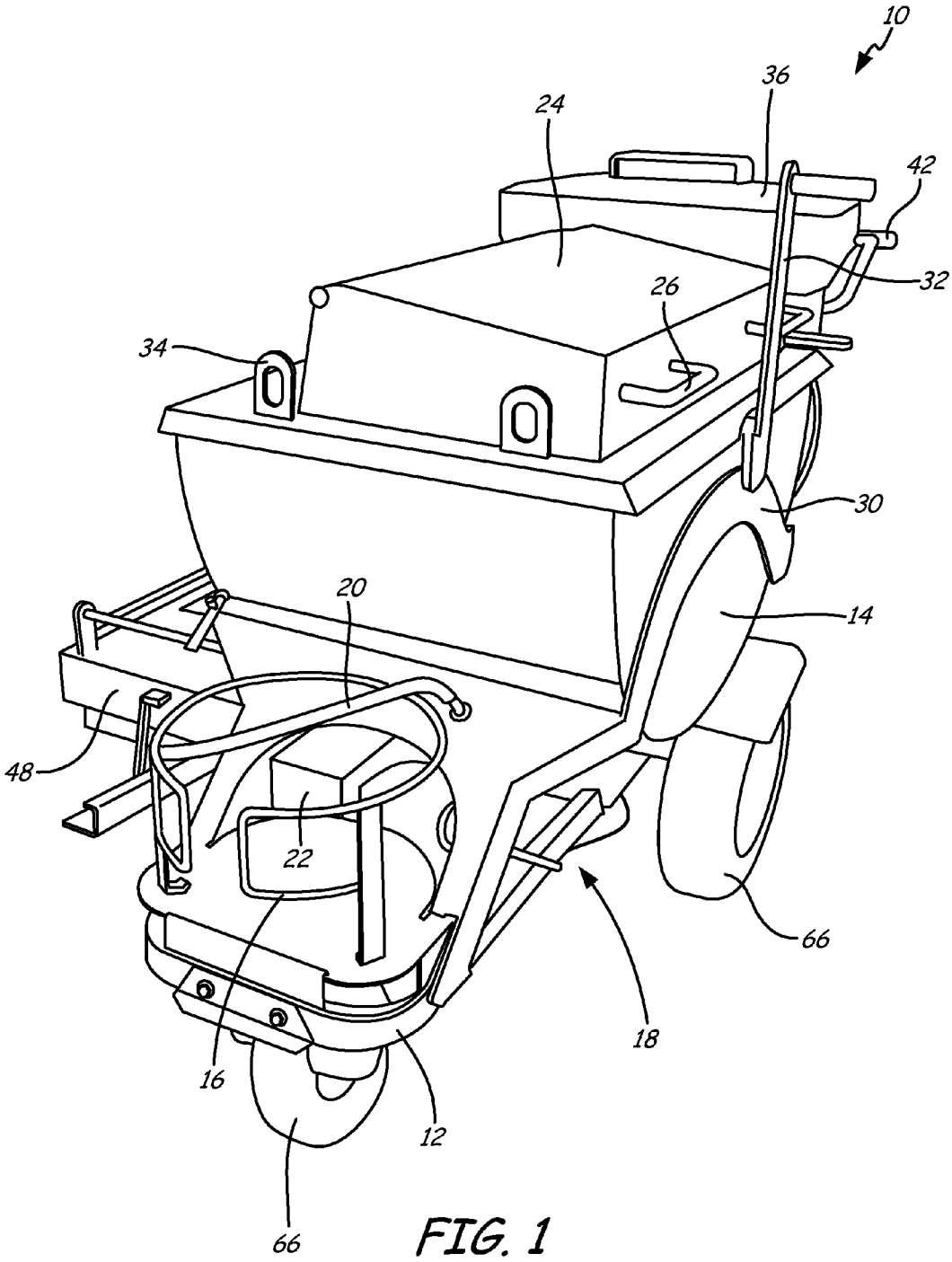
FIG. 1 is a first perspective view of a mobile applicator of the present invention.
Figure 2:
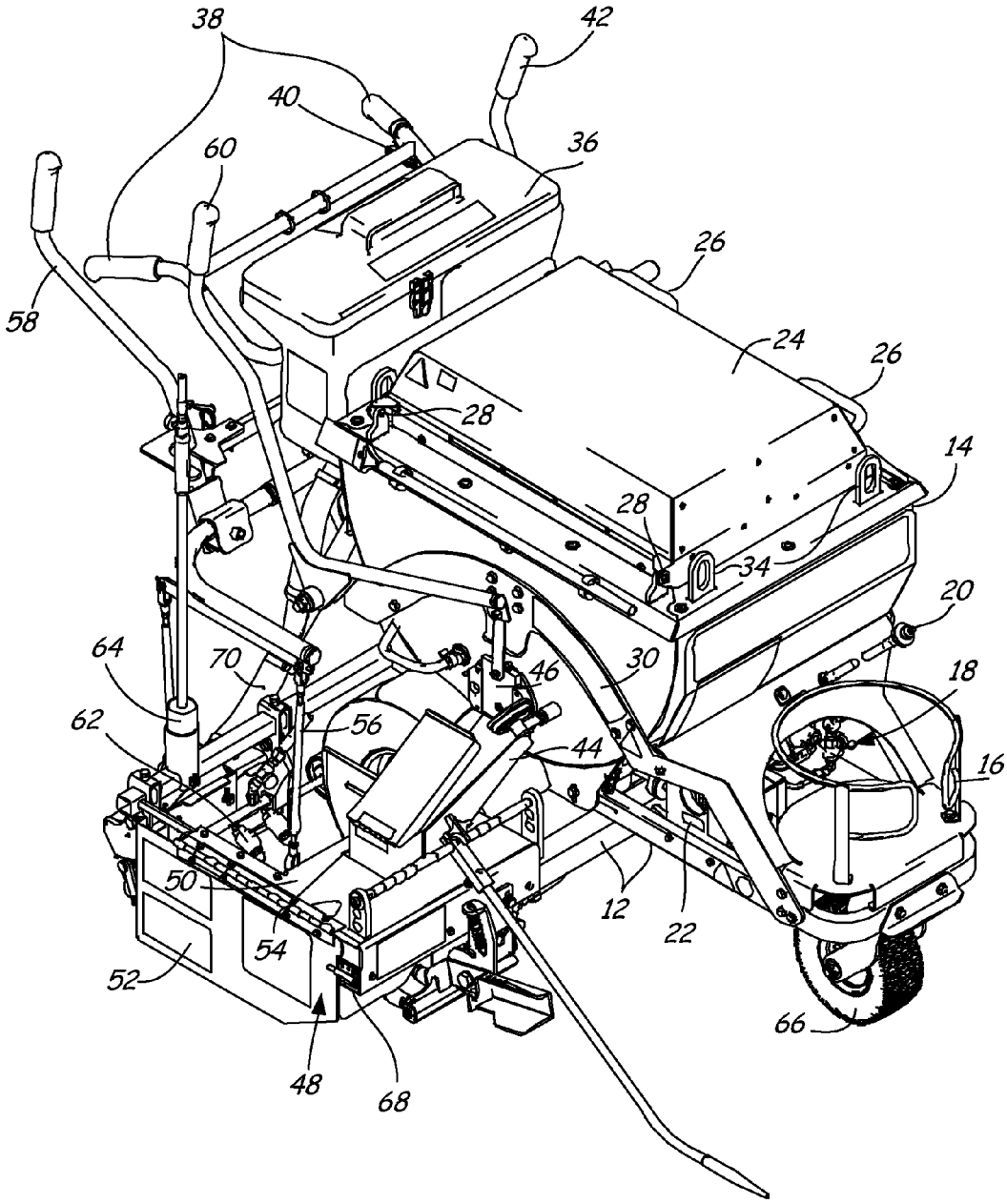
FIG. 2 is a second perspective view of the mobile applicator.

FIGS. 1 and 2 are perspective views of mobile applicator 10 that will be discussed simultaneously. Mobile applicator 10 comprises frame 12, kettle 14, gas tank cradle 16, gas system 18 (with gas tank hookup 20 and gas safety valve 22), kettle lid 24 (with lid handles 26 and lid hinges 28), kettle supports 30, agitator arm 32, lifting eyes 34, bead reservoir 36, push bar 38 (with handbrake 40), agitator lever 42, chute 44, gate valve 46, screed enclosure 48 (with screed enclosure top 50 and screed shroud door 52 connected at shroud door hinges 54), screed actuator link 56, screed actuator lever 58, gate valve lever 60, screed box burners 62, hand torch 64, wheels 66, shroud door latch 68, and bead tube 70.

Mobile applicator 10 is a tool capable of marking pavement lines by melting and then applying thermoplastic a pavement surface. Mobile applicator 10 includes frame 12 which provides support for other components of mobile applicator 12. Frame 12 may, for instance, be comprised of a framework of aluminum and/or steel beams, tubes, and struts. Gas tank cradle 16 is attached to frame 12 at the forward end of frame 12. Gas tank cradle 16 is a holding structure sized to retain a tank of propane, butane, or other appropriate combustible gas. Wheels 66 are rotatably attached to the bottom of frame 12 and allow mobile applicator 10 to move along pavement. In the illustrated embodiment, mobile applicator 10 includes three wheels 66: a single front wheel which swivels and provides directional control, and two rear wheels which track behind the front wheel. Push bar 38 is attached at the aft of frame 12 and includes handbrake 40. Push bar 38 allows a user to propel mobile applicator 10 and handbrake 40 allows the user to stop applicator 10, such that the user can direct where the pavement lines are made. One skilled in the art can appreciate that although directional terms such as "forward", "aft", "bottom", "top", "right side", and "left side" have been used in describing this invention, but such terms are merely relational descriptors of the illustrated embodiments shown herein.

Mounted to the top of frame 12 is kettle 14, which is a receptacle that is heated to melt granular thermoplastic for application to pavement surfaces. In the illustrated embodiment, kettle 14 is a substantially hemi-cylindrical receptacle heated from below by a plurality of gas burners. Kettle 14 may, for instance, be formed of aluminum. Kettle 14 is attached to frame 12 via kettle supports 30, which are rigid struts or surfaces formed, for instance, of steel or aluminum.

Kettle lid 24 covers the open top of kettle 14 and prevents molten thermoplastic and thermoplastic vapor and heat from escaping from kettle 14 during operation. Kettle lid 24 can be opened and closed with lid handles 26, which are attached to the left side of kettle lid 24. In some embodiments, kettle 14 may include latches which allow kettle lid 24 to be locked shut. Kettle lid 24 is connected to kettle 14 via lid hinges 28 which are on the right side of kettle lid 24 (opposite of lid handles 26). Lid hinges 28 may be any sort of conventional hinge selected for heat resilience and resistance to fouling when exposed to melted thermoplastic. In addition, kettle 14 includes agitator arm 32 which is connected to a plurality of agitators inside kettle 14 used to stir the molten thermoplastic.

Also attached to the top of kettle 14 are lifting eyes 34. Lifting eyes 34 are attachment points that allow mobile applicator 10 to be hoisted into position or loaded onto or off of a transportation vehicle. In the illustrated embodiment, lifting eyes 34 are tabs with holes which extend from the top surface of kettle 14, but a person skilled in the art will recognize that lifting eyes 34 may generally be any sort of load-bearing anchors for a hoist or crane, and could, for instance, be located on frame 12, instead.

At the bottom right side of kettle 14 is gate valve 46. Gate valve 46 is positioned between the interior of kettle 14 to chute 44. Chute 44 is a rigid, heat-resistant chute or trough which guides molten thermoplastic from kettle 14 to the screed die box. Chute 44 is comprised of a heat-resistant material including, but not limited to, aluminum or steel.

As stated previously, gas tank cradle 16 holds a tank of combustible gas (not shown), and gas from this tank is utilized by gas system 18. Gas system 18 is largely located beneath kettle 14 and kettle supports 30, and is anchored to frame 12. Gas system 18 includes gas hookup 20, a fluid connection which receives gas from a tank at gas tank cradle 16. Gas system 18 also includes gas safety valve 22, and a plurality of other valves and gas distribution tubes. Gas safety valve 22 is an electrically actuated multi-path valve which controls gas flow to the pilot burners and main burners heating kettle 14. Gas system 18 provides combustible gas to burners which heat kettle 14, and to screed box burners 62 and hand torch 64. Hand torch 64 is a handheld burner which can be used by a human operator to touch up or remove thermoplastic applied using mobile applicator 10 and is therefore located at the aft of mobile applicator 10. In addition, screed box burners 62 are connected to gas system 18.

Screed enclosure 48 is anchored to frame 12 at the bottom right side of frame 12. Screed enclosure 48 includes screed enclosure top 50 and screed shroud door 52. Screed enclosure 48 surrounds screed box burners 62 and the screed die box (see FIG. 3, below). Screed enclosure top 50 partially covers the screed die box, and screed shroud door 52 is connected to screed enclosure top 50 by shroud door hinges 54, such that screed shroud door 52 can be pivoted upward from door hinges 54 to reach, remove, or insert the screed die box. Screed shroud door 52 is secured to frame 12 by shroud door latch 68, which holds shroud door 52 in the depicted (closed) position during operation of mobile applicator 10. Screed enclosure 48 shields the screed die box from wind and debris and conversely shields the operator from the molten thermoplastic therein.

In order to operate mobile applicator 10, a user ignites the pilot burners and main burners under kettle 14. Then the user opens kettle lid 24 and deposits a sack of granular thermoplastic atop heat exchanger plenums located inside kettle 14. The sack itself is formed of a meltable thermoplastic material, so heat from main burners 116 melts the sack and the granules. The user can then rotate agitator arm 32 back and forth across a substantially 180° range, thereby sweeping the agitators through the interior of kettle 14 so as to mix the thermoplastic as it melts. Alternatively, the user can attach agitator arm 32 to agitator lever 42, allowing the user to move agitator arm 32 from the aft of mobile applicator 10.

Once the thermoplastic is uniformly melted, the user can pull gate valve lever 60, which opens gate valve 36. Opening gate valve 36 allows thermoplastic from kettle 14 to flow down chute 44 into the screed die box (shown in FIG. 3). Screed box burners 62 heat the screed die box, allowing the thermoplastic to remain molten as it is dispensed. In addition, light reflective beads are commonly used to provide increased visibility to thermoplastic stripes, for some applications. These beads, which are usually formed of glass, are deposited on freshly applied molten thermoplastic. Some embodiments of mobile applicator 10 include bead reservoir 36 (located at the top aft of mobile applicator 10), which is a receptacle for storing such glass beads. Bead tube 70 carries beads from bead reservoir 36 to screed enclosure 48, allowing beads to be deposited as thermoplastic is applied.

The components and configuration of mobile applicator 10 as shown in FIGS. 1 and 2 allow for a sack of thermoplastic granules to be transformed into a pavement line. This occurs by mobile applicator 10 melting the thermoplastic in kettle 14, transferring the melted thermoplastic into a screed die (shown in FIG. 3) via gate valve 46 and chute 44, and dispensing the molten thermoplastic onto the pavement. A pavement line is formed as the user propels mobile applicator 10.

FIGS. 1 and 2 depict one embodiment of the invention, to which there are alternatives. For example, mobile applicator 10 can include mounting points such that mobile applicator 10 can be attached to a motor vehicle. In such an embodiment, the motor vehicle pushes and/or pulls mobile applicator 10 in order to direct where the pavement lines are made.

Figure 3:
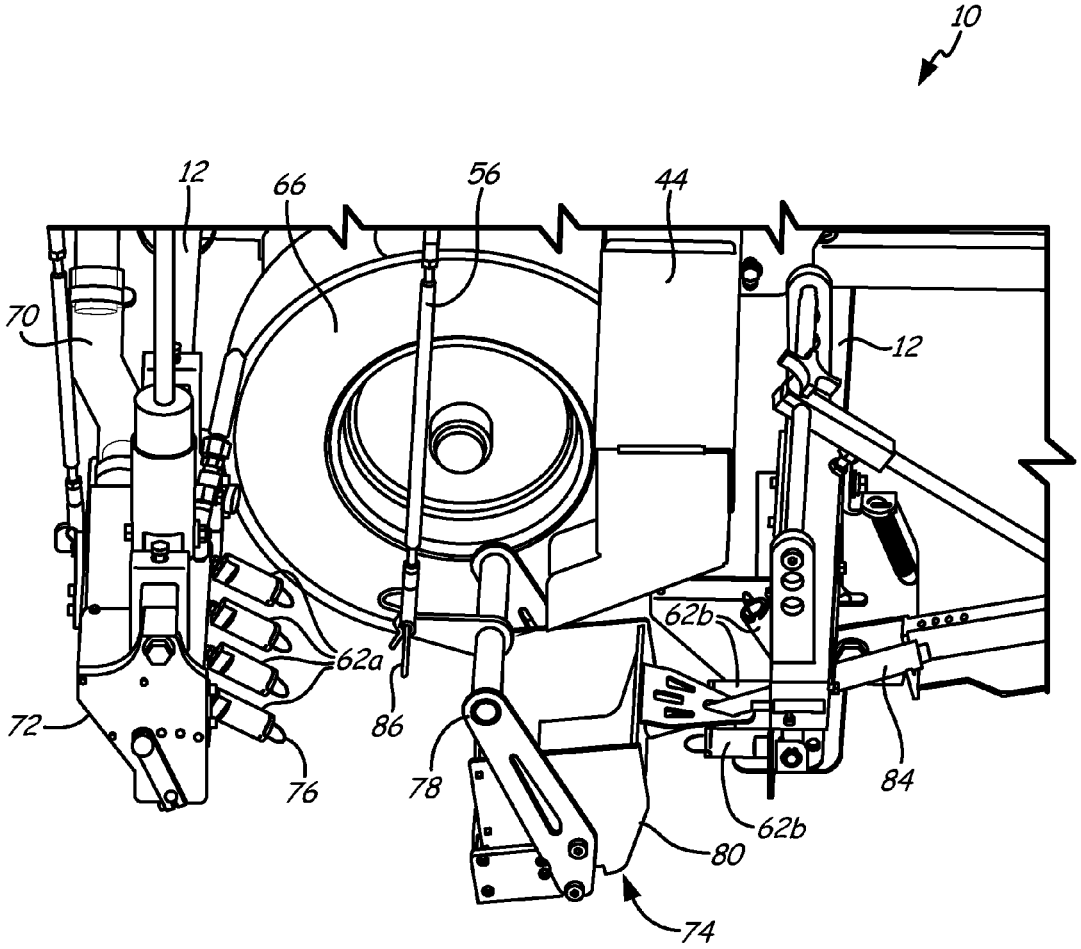
FIG. 3 is a perspective view of a screed die box of the mobile applicator.

FIG. 3 provides a close-up view of die box 74 and surrounding components of mobile applicator 10, with screed enclosure 48 removed for increased visibility. FIG. 3 depicts frame 12, chute 44, screed actuator link 56, screed burners 62 (including four aft screed burners 62*a* and three fore burners 62*b*), wheel 66, bead tube 70, bead dispenser 72, screed die box 74, and flame indicators 76. Screed die box 74 comprises screed die box lever 78, screed die box bucket 80, screed die box gate 82, screed die box anchor 84, and retention pin 86.

As stated above with respect to FIGS. 1 and 2, screed die box 74 is positioned beneath chute 44 in order to receive molten thermoplastic from chute 44. Screed die box 74 is primarily comprised of screed die bucket 80, a five-sided container open on top to receive thermoplastic from chute 44. Screed die bucket 80 is anchored relative to other components of mobile applicator 10 by screed die box anchor 84, which is welded to or integrally formed on the forward side of bucket 80. In the illustrated embodiment, screed die box anchor 84 is an elongate post which extends through and can be locked into place relative to frame 12. Screed die box anchor 84 can be locked in place to frame 12 anywhere along the length of die screed die box anchor 84, allowing the position of screed die box 74 to be adjusted for different applications. A person skilled in the art will recognize that screed die box 74 could alternatively be anchored to frame 12 by other flexible or inflexible means, and that screed die box anchor 84 could accordingly take other forms which equivalently allow screed die box 74 to be secured to frame 12. Screed die box anchor 84 may double as a handle used by operators to install, remove, and transport screed die box 74.

Screed die box lever 78 attaches to a screed die box gate (not shown). The screed die box gate is a slidable plate along the bottom of screed die bucket 80. Screed die box lever 78 is detachably attached to screed actuator link 56 by means of retention pin 86, and is fastened to the screed die box gate. When screed actuator lever 58 (shown in FIG. 2) is pulled or pushed, a torque is applied to screed die box lever 78 via screed actuator link 56, which opens or closes the screed die box gate. The screed die box gate opens and closes by shifting forward or aftward to create or remove an open space in the bottom of screed die box bucket 80. Screed die box 74 may have a plurality of distinct embodiments with different dimensions and additional features for use in different applications, any of which may be freely swapped in and out of mobile applicator 10 by fastening screed die box 74 to frame 12 using screed die box anchor 84, and attaching screed die box lever 78 to screed actuator link 56 with retention pin 86.

Also shown in FIG. 3, bead dispenser 72 is attached to frame 12 and supports aft screed burners 62*a*. Bead dispenser 72 receives and deposits visibility-enhancing beads from bead tube 70, as understood in the art. In addition, fore burners 62*b* are supported by frame 12 and are located forward of screed die box 74.

Screed die box 74 is heated by screed burners 62, to ensure that thermoplastic deposited in screed die box 74 from chute 44 remains molten during the application process. As stated previously, all screed burners 62 receive combustible gas from gas system 18. Screed burners 62 include aft screed burners 62*a*, which are directed to an aft portion of screed die box 74, and fore screed burners 62*b*. Although the embodiment of mobile applicator 10 depicted in FIG. 3 includes four aft screed burners 62*b* and three fore screed burners, a person skilled in the art will understand that the number and placement of screed burners may be varied without departing from the spirit of the present invention. In particular, some embodiments of mobile applicator 10 may not include aft screed burners 76. Alternatively, one or both of aft and fore screed burners 62*a* and 62*b*, respectively, may be modular components which may be connected to gas system 18 if and when desired. As shown in FIG. 3, two of fore screed burners 62*b* are directed to a fore portion of screed die box 74 near where screed die box anchor 84 attaches to screed die box bucket 80, while a third screed burner 62*b* is directed at chute 44 to prevent thermoplastic from solidifying in chute 44. As depicted, all screed burners are ignited manually, although a person skilled in the art will recognize that automatic ignition tools such as electrical sparkers may be utilized instead.

The components and configuration of mobile applicator 10 as shown in FIG. 3 allow for molten thermoplastic to be applied to pavement. Screed burners 62 heat die box 74 and chute 44, allowing molten thermoplastic to flow smoothly from kettle 14 into screed die box 74 and maintaining thermoplastic in screed die box 74 in a molten state. By pulling screed actuator lever 58 (shown in FIG. 2), an operator can deposit molten thermoplastic from screed die box 74 onto a pavement surface.

Figure 4:
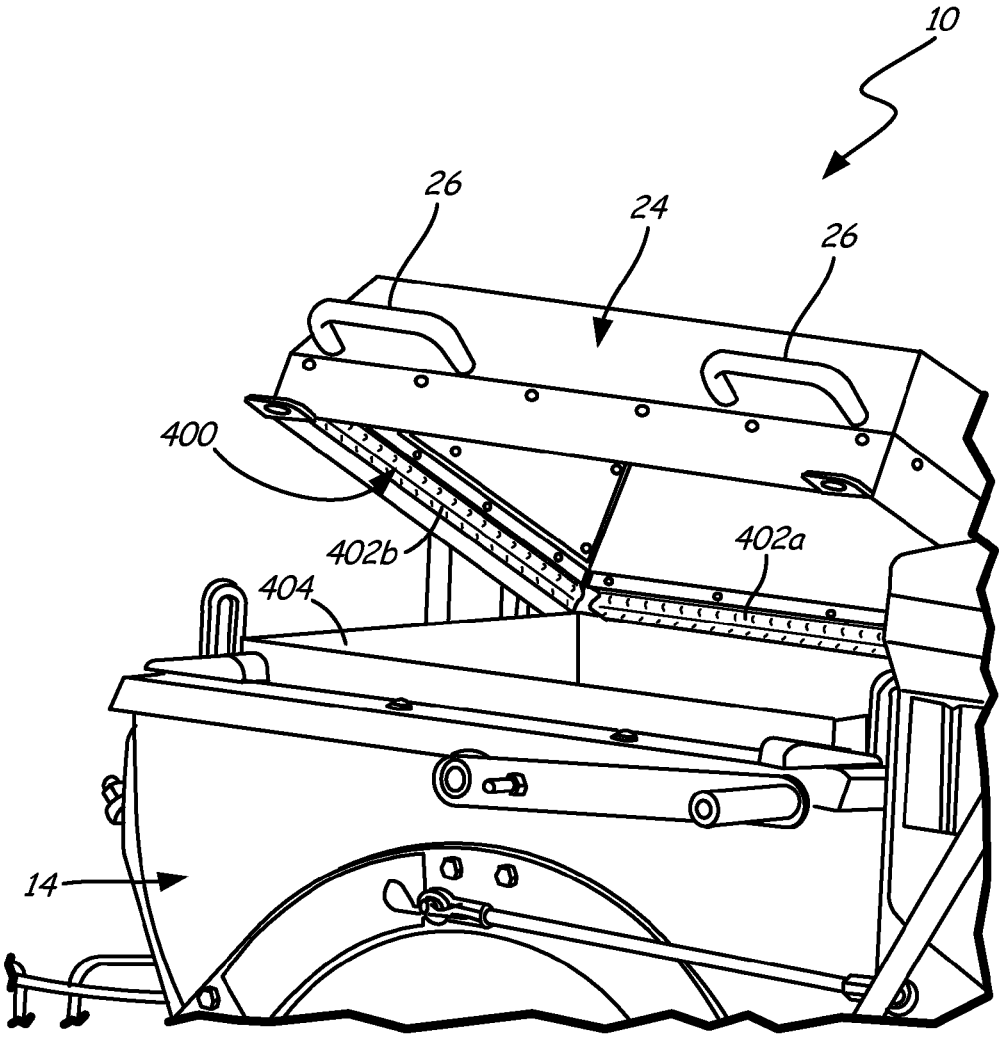
FIG. 4 is a perspective view of a lid to a kettle assembly.
Figure 6:
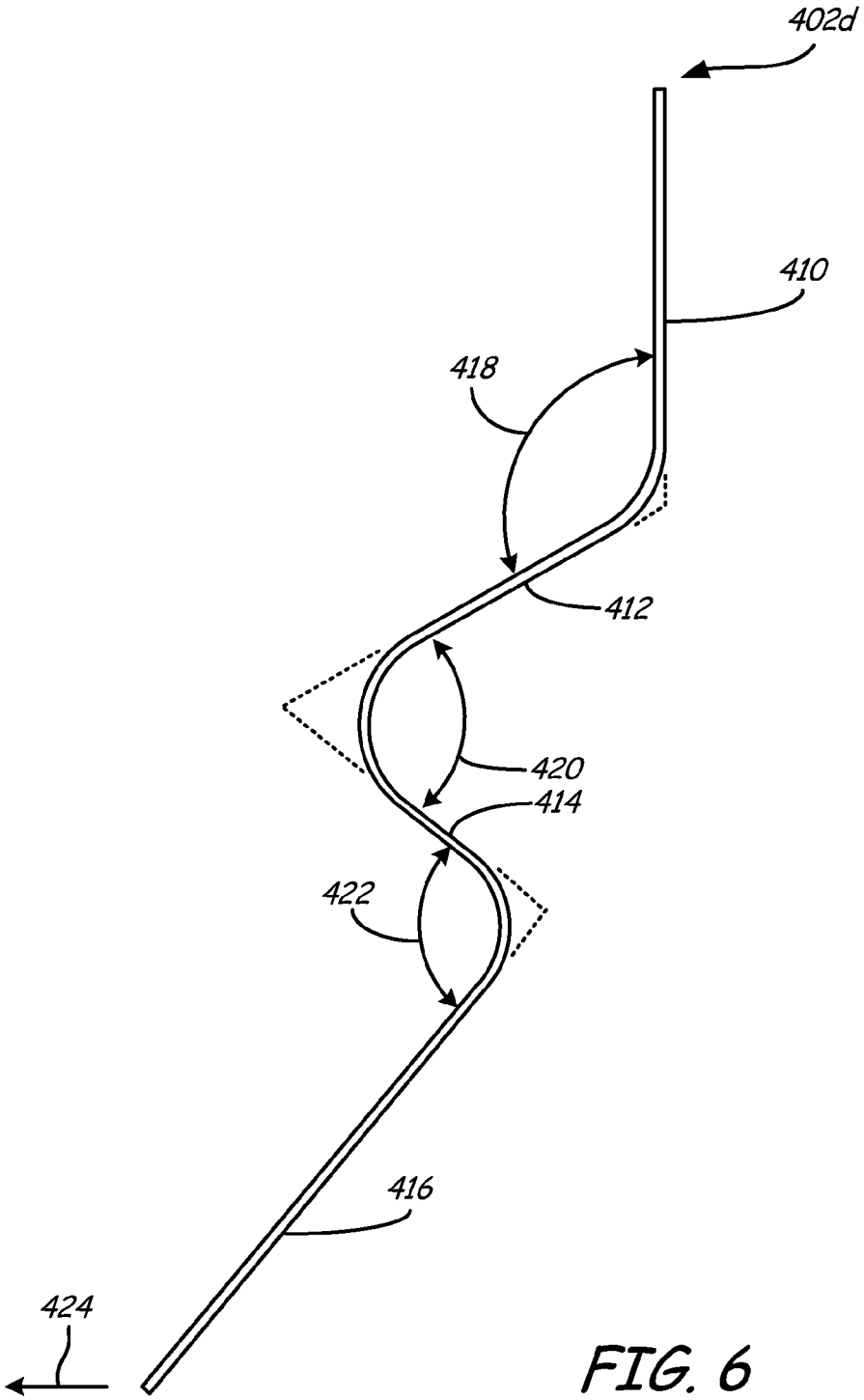
FIG. 6 is a cross-sectional view of a seal bar of the seal.

FIG. 4 shows a perspective view of kettle 14 with kettle lid 24 in an open position. FIG. 4 depicts kettle 14 with seal jamb 404 and kettle lid 24 with lid seal 400. Lid seal 400 comprises seal bars 402*a*-402*d*. Although only seal bars 402*a*-402*b* are visible in FIG. 4, seal bar 402*d* is shown in FIG. 6 but seal bar 402*c* is not shown.

In the illustrated embodiment, seal jamb 404 is attached to the top surface of kettle 14 and extends substantially vertically therefrom. Seal jamb 404 is a rectangular arrangement of sheet metal that is surrounded by kettle lid 24 when kettle lid 24 is in the closed position. Similarly, in order to form lid seal 400, seal bars 402*a*-402*d* are arranged in a corresponding rectangular pattern to seal jamb 404. Referring to the directional convention established in FIGS. 1 and 2, when kettle lid 24 is closed, seal bar 402*a* is on the right side of kettle lid 24. Then, seal bar 402*b* is on the forward side of kettle lid 24, seal bar 402*c* (not shown) is on the left side of kettle lid 24 (on the opposite side of kettle lid 24 from lid handles 26 and opposing seal bar 402*a*), and seal bar 402*d* is on the aftward side of kettle lid 24 (opposing seal bar 402*b*).

Additionally when kettle lid 24 is closed, seal 400 engages seal jamb 404. As kettle lid 24 is moved from the fully opened position to the closed position, seal bar 402*a* contacts seal jamb 404 before seal bars 402*b*-402*d* do. This is because seal bar 402*a* is closest to the axis of rotation of kettle lid 24. As kettle lid 24 is closed further, seal bars 402*b* and 402*d* simultaneously contact seal jamb 404. Lastly, seal bar 402*c* contacts seal jamb 404 as kettle lid 24 is moved to the closed position.

The components and configuration of kettle 14 and kettle lid 24 as shown in FIG. 4 allow for kettle 14 to be sealed when kettle lid 24 is in the closed position. This prevents the escape of fumes from the thermoplastic in interior space 326 into the surrounding environment. Seal 400 further serves to prevent condensation and solidification of thermoplastic material on the top surface of kettle 14 around kettle lid 24. This allows kettle lid 24 to be opened after cooling down from operation without reheating kettle 14.

Figure 5:
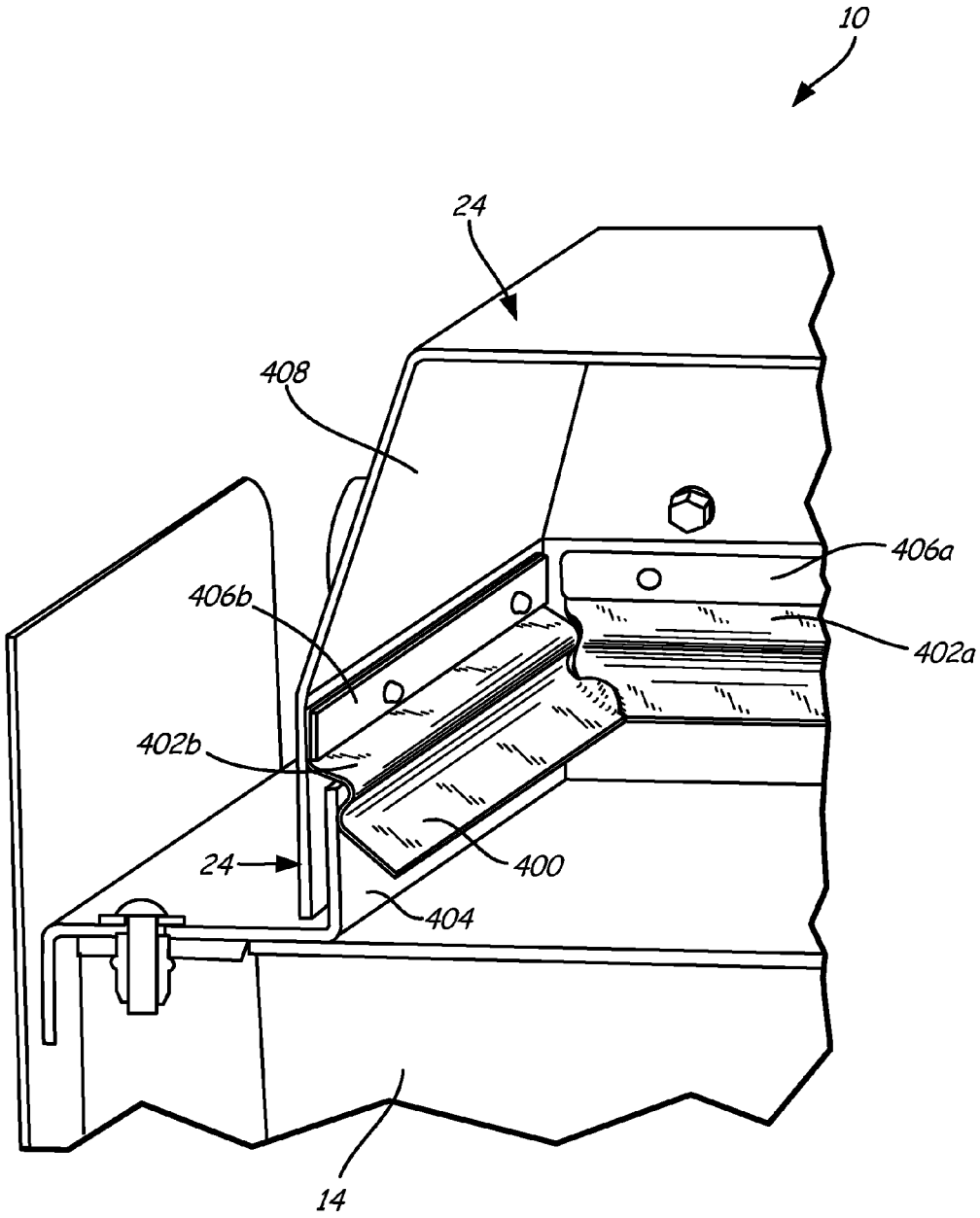
FIG. 5 is a cross-sectional perspective view of a seal for the lid of the kettle assembly in a closed position.

FIG. 5 shows is a cross-sectional perspective view of seal jamb 404 of kettle 14 and lid seal 400 of kettle lid 24 in a closed position. Shown in FIG. 5 are kettle 14 including seal jamb 404 and kettle lid 24 with lid seal 400 attached to lid interior 408. Lid seal 400 comprises seal bars 402*a*-402*d* and seal retainers 406*a*-406*d* (although only seal bars 402*a*-402*b* and seal retainers 406*a*-406*d* are visible in FIG. 5).

As stated previously, lid seal 400 is attached to kettle lid 24. More specifically, seal bars 402*a*-402*d* are held against lid interior 408 by seal retainers 406*a*-406*d*, respectively. In the illustrated embodiment, seal retainers 406*a*-406*d* are riveted to kettle lid 24. One skilled in the art will appreciate that other methods of attaching seal bars 402*a*-402*d* are possible, including methods that would eliminate the need for seal retainers 406*a*-406*d* (such as welding).

In FIG. 5, kettle lid 24 is in the closed position, so seal 400 is engaging seal jamb 404. Such engagement means that seal jamb 404 is positioned between kettle lid 24 and seal 400. This occurs by seal bars 402*a*-402*d* bending inward away from kettle lid 24, which is possible because lid seal 400 is comprised of a heat resistant, elastically deformable material such as 1060 high carbon spring steel.

The components and configuration of kettle 14 and kettle lid 24 as shown in FIG. 5 allow for seal 400 to flex as it engages seal jamb 404. Not only does this elastic deformation create a tight seal, it also wipes or scrapes any melted thermoplastic material off of seal jamb 404.

FIG. 6 shows a cross-sectional view of seal bar 402*d*. Seal bar 402*d* is comprised of first seal portion 410, second seal portion 412, third seal portion 414, and fourth seal portion 416. While all seal bars 402*a*-402*d* may not be the same as seal bar 402*d*, for the present purposes, seal bar 402*d* is representative of seal bars 402*a*-402*d*.

Seal portions 410-416 are linearly connected to one another, although first seal bend 418 is positioned between first seal portion 410 and second seal portion 412. Similarly, second seal bend 420 is positioned between second seal portion 412 and third seal portion 414, and third seal bend 422 is positioned between third seal portion 414 and fourth seal portion 416.

Generally, seal bar 402*d* extends downward toward kettle 14 (shown in FIG. 5) and away from the vertical sides of kettle lid 24 (which is inward toward the center of kettle 14). In the illustrated embodiment, first seal bend 418 is 120° down from the vertical direction, away from kettle lid 24 (shown in FIG. 5). Then, second seal bend 420 is 70° from the orientation of second seal portion 412, back towards kettle lid 24. Third seal bend 422 is 90° from the orientation of third seal portion 414, away from kettle lid 24. One skilled in the art can appreciate that the exact dimensions of seal bends 418-422 are merely exemplary and can be varied by at least 10% while still maintaining the functionality of seal bars 402*a*-402*d*.

The configuration of seal bars 402*a*-402*d* allows for seal 400 (shown in FIG. 5) to flex inward from kettle lid 24 (shown in FIG. 5) as seal 400 engages seal jamb 404 (shown in FIG. 5). As shown in FIG. 6, when seal bar 402*d* engages seal jamb 404, seal bar 402*d* generally elastically deforms along deformation direction 424, which is pointed away from kettle lid 24.

Figure 7:
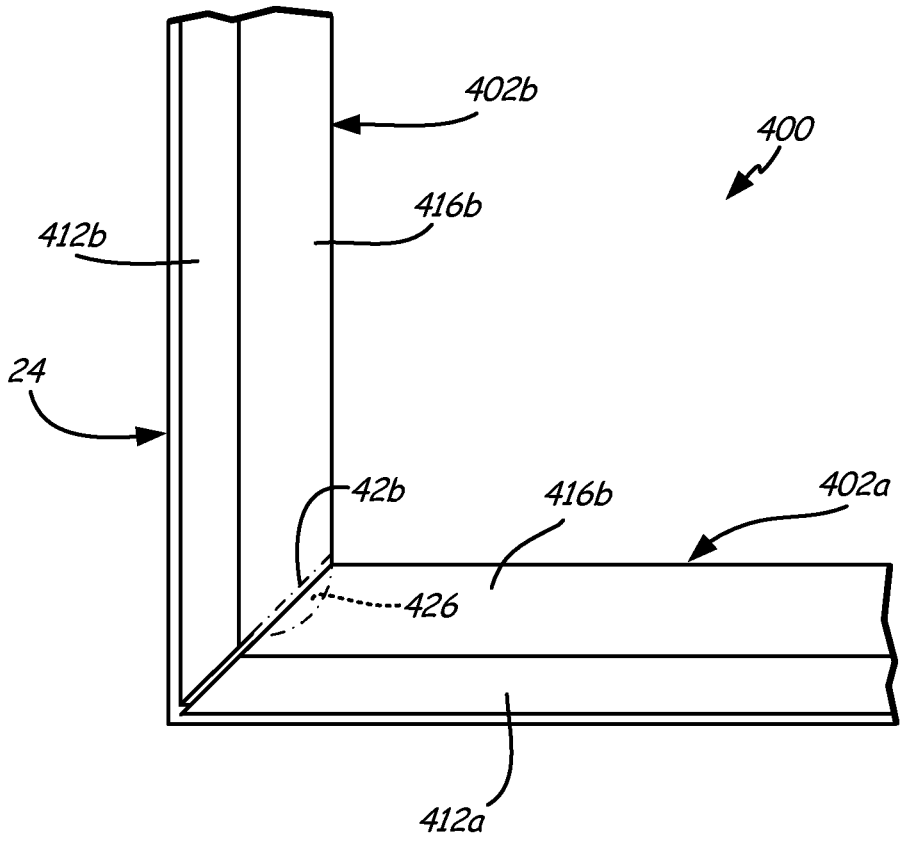
FIG. 7 is a broken view showing a corner of the seal.

FIG. 7 shows a broken view of the right, forward corner of the lid seal 400 in kettle lid 24. The vantage point in FIG. 7 is taken from directly underneath the corner where seal bars 402*a* and 402*b* intersect. Therefore, second seal portions 412*a*-412*b* and fourth seal portions 416*a*-416*b* are visible. In addition to seal portions 410*b*-416*b*, seal bar 402*b* includes seal tab 426. Because seal bar 402*b* has tab bend 428, seal tab 426 overlaps seal bar 402*a*, behind seal bar 402*a* such that seal tab 426 is between kettle lid 24 and seal bar 402*a*.

While FIG. 7 only shows the intersection between seal bars 402*a* and 402*b*, a similar arrangement is present at the other corners as well. This is because seal bars 402*b* and 402*d* are opposed to each other on kettle lid 24 and both ends of seal bars 402*b* and 402*d* have tabs 426 (for a total of four tabs 426). Specifically, seal bar 402*b* has another tab 426 (not shown) that overlaps behind seal bar 402*c*, and seal bar 402*d* has a tab 426 at each end (not shown) that overlaps behind seal bar 402*a* and 402*c*, respectively.

As stated previously, seal bar 402*a* engages seal jamb 404 (shown in FIG. 5) first as kettle lid (shown in FIG. 5) is closed. As seal bar 402*a* deforms, it is pulled nearer to or into contact with tab 426 of seal bar 402*b*. Due to tolerance and deformation issues, seal 402*a* may not contact seal bar 402*b* along the entire lengths of their adjacent ends. The arrangement of tab 426 restricts flow between seal bars 402*a* and 402*b*. Because such an arrangement is present at all corners of seal 400, the effectiveness of seal 400 is increased.

It should be recognized that the present invention provides numerous benefits and advantages. Lid seal 400 protects workers from the fumes emanating from melting or molten thermoplastic, conserves heat inside kettle 14, and allows for the opening of a cold kettle 14. This is made possible due to the components and configuration of lid seal 400 on kettle lid 24 and its interaction with seal jamb 404 on kettle 14 when kettle lid 24 is in the closed position.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A seal arrangement comprising:

a kettle;

a seal jamb attached to the kettle;

a kettle lid rotatably connected to the kettle, the kettle lid being rotatable between an open and a closed position; and a lid seal connected to the kettle lid, the lid seal engaging the seal jamb when the kettle lid is in the closed position;

wherein the lid seal includes a seal bar comprising:

a first portion that is attached to the kettle lid;

a second portion connected to the first portion that extends away from the kettle lid;

a third portion connected to the second portion that extends towards the kettle lid; and a fourth portion connected to the third portion that extends away from the kettle lid.

2. The seal arrangement of claim 1, wherein the lid seal is connected to an interior of the kettle lid.

3. The seal arrangement of claim 1, wherein the seal jamb is positioned in an interior of the kettle lid when the kettle lid is in the closed position.

4. The seal arrangement of claim 1, wherein the seal jamb being positioned between the kettle lid and the lid seal when the kettle lid is in the closed position.

5. The seal arrangement of claim 1, wherein the lid seal is comprised of four seal bars arranged in a rectangular pattern around the kettle lid.

6. The seal arrangement of claim 5, wherein both ends of two of the seal bars in the rectangular arrangement include tabs that overlap the adjacent seal bars in the rectangular arrangement.

7. The seal arrangement of claim 6, wherein the nearest seal bar to the axis of rotation of the kettle lid that extends parallel to an axis of rotation of the kettle lid is positioned between the seal jamb and the tabs of the two adjacent seal bars when the kettle lid is in the closed position.

8. The seal arrangement of claim 1, wherein the seal jamb extends substantially vertically from the kettle.

9. A mobile applicator including the seal arrangement of claim 1, and further comprising:

a frame;

a plurality of wheels rotatably connected to the frame; and a screed die box positioned to receive thermoplastic material from the kettle;

wherein the kettle is attached to the frame for holding a thermoplastic material.

10. The seal arrangement of claim 1, wherein the second portion extends from the first portion at substantially a 120 degree angle.

11. The seal arrangement of claim 10, wherein the third portion extends from the second portion at substantially a 70 degree angle.

12. The seal arrangement of claim 1, wherein the fourth portion extends from the third portion at substantially a 90 degree angle.

* * * * *